United States Patent [19]

Comer

[11] Patent Number: 4,942,298

[45] Date of Patent: Jul. 17, 1990

[54] ELECTRON SPECTROMETER

[75] Inventor: John Comer, Stockport, United Kingdom

[73] Assignee: The Victoria University of Manchester, United Kingdom

[21] Appl. No.: 235,872

[22] PCT Filed: Feb. 18, 1987

[86] PCT No.: PCT/GB87/00118

§ 371 Date: Oct. 20, 1988

§ 102(e) Date: Oct. 20, 1988

[87] PCT Pub. No.: WO87/05151

PCT Pub. Date: Aug. 27, 1987

[30] Foreign Application Priority Data

Feb. 20, 1986 [GB] United Kingdom ..... 8604256

[51] Int. Cl.[5] ..... H01J 49/44

[52] U.S. Cl. ..... 250/305

[58] Field of Search ..... 250/296, 305

[56] References Cited

U.S. PATENT DOCUMENTS

| | | | |
|---|---|---|---|
| 3,777,159 | 12/1973 | Hammond et al. | 250/305 |
| 4,300,045 | 11/1981 | Ibach et al. | 250/305 |
| 4,435,642 | 3/1984 | Neugebaur et al. | 250/296 |
| 4,559,449 | 12/1985 | Kesmodel | 250/305 |
| 4,584,474 | 4/1986 | Franchy | 250/305 |
| 4,758,723 | 7/1988 | Wardell et al. | 250/305 |
| 4,851,670 | 7/1989 | Krivanek | 250/305 |

*Primary Examiner*—Bruce C. Anderson

*Attorney, Agent, or Firm*—Nixon & Vanderhye

[57] ABSTRACT

An electron spectrometer comprising an electron source for providing a beam of electrons having a predetermined energy spectrum, and an electron selector for dispersing in energy the electrons of the beam to produce an elongate selector image, each portion of the length of which includes electrons having a predetermined respective energy. The selector image is focussed on a target to produce an elongate target image including scattered electrons having a range of energies, each portion of the length of the target image resulting from a respective portion of the length of the selector image. An analyzer disperses in energy the scattered electrons of the target image, the analyzer being orientated such that the electrons are dispersed in a direction substantially perpendicular to the length of the target image, whereby the analyzer produces a rectangular image made up of substantially parallel strips, each including electrons of a range of energies but each resulting from the scattering by the target of electrons of a respective energy.

5 Claims, 2 Drawing Sheets

ELECTRON SPECTROMETER

BACKGROUND OF THE INVENTION

1. Field of the Invention

The present invention relates to an electron spectrometer of the type in which a substance under investigation is bombarded with electrons and the spectra of electrons scattered from the substance are studied. Spectrometers of this type are used to investigate for example the atomic and molecular structure of materials. The substance which is bombarded with electrons is generally referred to as the target.

The basic principles of electron spectrometry are well known and a useful description of these principles is contained in U.S. Pat. No. 3,777,159. In conventional electron spectrometers, a beam of electrons provided by an electron source is initially dispersed in energy. A monochromatic beam (in which all the electrons have the same energy) is selected from the dispersed output of the electron source and the monochromatic beam is used to bombard a target. A beam of scattered electrons results the energies of which vary and this beam of scattered electrons is in turn dispersed in energy and detected by a linear array of detectors. The output of each detector is representative of the number of electrons scattered from the target having an energy corresponding to the position of that detector.

It has been proposed to provide two dimensional electron spectrometers in which the single linear array of detectors provided in one dimensional spectrometers is replaced by a two dimensional array made of a series of arrays of detectors arranged in parallel. In one known electron spectrometer the detectors are in the form of a 100×100 photodiode array. In all the known electron spectrometers however, the target is bombarded with a monochromatic beam of electrons so that appropriate conclusions can be drawn from the detected energy of the resultant scattered electrons. The use of a monochromatic beam does however mean that only a small proportion of the output of the electron source is in fact utilized to bombard the target.

SUMMARY OF THE INVENTION

It is an object of the present invention to improve the sensitivity of electron spectrometers.

According to the present invention there is provided an electron spectrometer comprising an electron source for providing a beam of electrons having a predetermined energy spectrum, an electron selector for dispersing in energy the electrons of the beam to produce an elongate selector image each portion of the length of which comprises electrons having a predetermined respective energy, means for focussing the selector image on a target to produce an elongate target image including scattered electrons having a range of energies, each portion of the length of the target image resulting from a respective portion of the length of the selector image, and an analyzer for dispersing in energy the scattered electrons of the target image, the analyzer being orientated such that the electrons are dispersed in a direction substantially perpendicular to the length of the target image, whereby the analyzer produces a rectangular image made up of substantially parallel strips each including electrons of a range of energies but each resulting from the scattering by the target of electrons of a respective energy.

The invention also provides a method for producing a two-dimensional image of a target in an electron spectrometer, wherein a beam of electrons having a range of energies is dispersed in energy to produce an elongate selector image each portion of the length of which comprises electrons having a predetermined respective energy, the selector image is focussed on the target to produce an elongate target image including scattered electrons having a range of energies, each portion of the length of the target image resulting from a respective portion of the length of the selector image, and the scattered electrons of the target image are dispersed in energy, the direction of dispersion of the scattered electrons being substantially perpendicular to the length of the elongate target image, whereby a rectangular image is formed of substantially parallel strips each including electrons of a range of energies but each resulting from the scattering by the target of electrons of a respective energy.

BRIEF DESCRIPTION OF THE DRAWINGS

An embodiment of the present invention will now be described, by way of example, with reference to the accompanying drawings, in which.

DETAILED DESCRIPTION OF EXEMPLARY EMBODIMENTS

Figure 1:
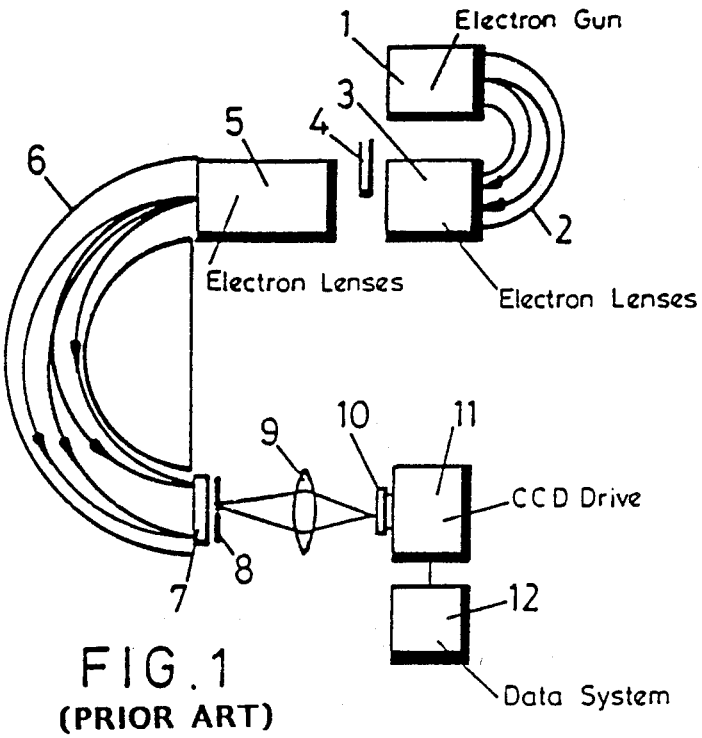
FIG. 1 (PRIOR ART)
FIG. 1 is a schematic illustration of a known multidetector spectrometer.

Referring to FIG. 1, an electron gun 1 produces a beam of electrons having a range of energies and this electron beam is dispersed in energy by a conventional hemispherical deflector 2. A monochromatic beam of electrons is selected from the output of the deflector 2 using a conventional slit aperture (not shown) and this monochromatic beam is focussed by a first set of electron lenses 3 on a target 4. Electrons scattered from the target 4 are focussed by a second set of electron lenses 5, the scattered electrons having a range of energies.

The beam of scattered electrons is dispersed in energy using a further hemispherical deflector 6 so as to project an extended electron image onto multichannel plates 7 which are of conventional form and enable the extended electron image to be amplified. The amplified electron image is accelerated onto a phosphor screen 8 to produce an equivalent optical image which is then focussed by an optical system represented by lens 9 onto a charge coupled device 10. The charge coupled device 10 is connected to a conventional CCD drive 11 which supplies data to a conventional data system 12.

The extended electron image is elongate and each portion of its length corresponds to a respective scattered electron energy. The energy of electrons incident upon the target is known and accordingly an analysis of the energy of the scattered electrons enables the structure of the target to be investigated.

Figure 2:
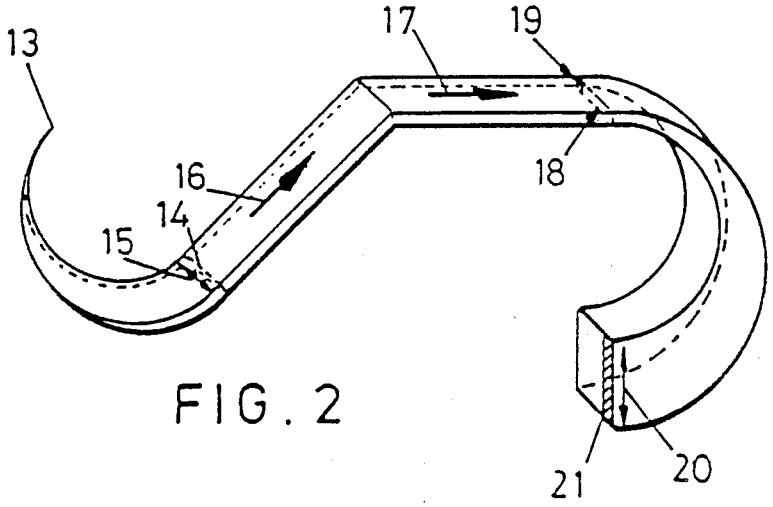
FIG. 2 is a schematic illustration of the paths followed by electrons in an embodiment of the present invention.

Referring now to FIG. 2, this is a schematic illustration of the path followed by electrons in a spectrometer in accordance with the present invention. Electrons having a range of energies originate at point 13 and are dispersed in energy by a conventional hemispherical deflector or selector so as to form an elongate selector image at the position indicated by dotted line 14, the energies being spread in the direction of arrow 15. Electrons from the selector image travel in the direction of arrow 16 and are scattered in all directions by a target. Scattered electrons which travel in the direction of arrow 17 result in a target image at the position indicated by dotted line 18. The shaded area 19 corresponds to scattered electrons having a range of energies but resulting from a monochromatic sub-portion of the selector image.

Electrons from the target image are dispersed in energy in a further conventional hemispherical deflector or analyzer, the direction of dispersion being perpendicular to the length of the target image. Thus the scattered electrons from the area 19 of the target image are dispersed in the direction of arrow 20 to form the strip-shaped area 21. The area 21 is effectively an energy loss spectrum corresponding to the area 19 of the target image. Each portion of the target image 18 will of course result in a corresponding strip shaped area with the strip shaped areas making up a rectangular final image. That final image can be applied to multi-channel plates of the type shown in FIG. 1 to produce a corresponding optical image for viewing by a two dimensional rectangular CCD device or photodiode array for example. The spectrometer thus produces at its exit a two dimensional image containing significant information in both dimensions. Although there is a range of energies in the dispersed electron beam which is used to bombard the target this has no effect on the overall resolution. The increase in intensity of the incident electron beam results in a substantial improvement in sensitivity.

The direction of dispersion in the analyzer deflector will not normally be the same across the full width of the analyzer deflector because of distortion of the electron beam. Generally the direction of dispersion in the analyzer deflector is arranged to be perpendicular to the axis of the target image at the center of the image. On either side of the center of the image the direction of dispersion is only substantially perpendicular to the target image axis. This distortion is generally negligible but in some circumstances appropriate corrections may be thought necessary.

Figure 3:
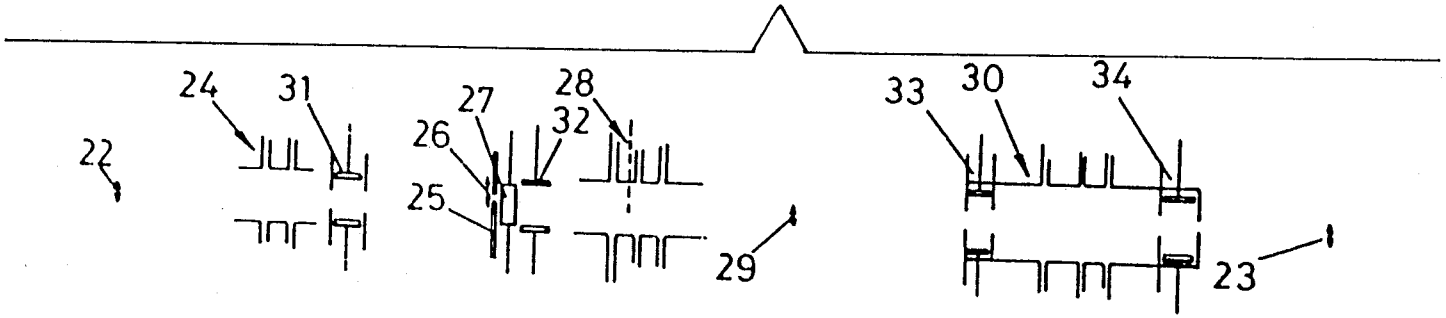
FIG. 3 is a schematic illustration of component parts of the electron lenses of an embodiment of the present invention.

Referring now to FIG. 3, the structure of electron lenses positioned between a selector image 22 and a target image 23 is illustrated. The images 22 and 23 correspond to the images appearing at the positions 14 and 18 of FIG. 2. Conventional electron lens structures are used, but the selector and analyzer are mounted at 90° to each other as compared with conventional spectrometers.

Referring to FIG. 3 in detail, the selector image 22 is the output of a conventional hemispherical deflector which disperses in energy the output of an electron gun, the dispersion being in the direction of the arrows at position 22. A first lens 24 focusses electrons from the selector image 22 on a plate 25 in which an elongate slit 26 is formed. The slit is elongate in the direction of the arrows indicated at position 26 and thus electrons having a range of energies pass through the defining aperture formed by the plate 25.

Electrons passing through the slit in the plate 25 pass between a pair of plates 27 which as described in more detail hereinafter cause the electron beam to be rotated about the axis of the lens system to compensate for small misalignments of the selector deflector and analyzer deflector and to compensate for the effects of any stray electric or magnetic fields which may rotate the image slightly. The electron beam is then focussed by a second lens 28 onto a target at the position indicated by arrows 29. The electron beam electrons reaching the target position 29 are dispersed in energy in the direction of the arrows at position 29.

The image at the position indicated by arrows 29 is focussed by a third lens 30 onto the position indicated by the arrows 23. Thus the target image at the position indicated by arrows 23 corresponds to the image shown at position 18 in FIG. 2. Each portion of the target image comprises electrons of a range of energies but with each of the electrons resulting from scattering of electrons of a single energy. The image at position 23 is dispersed in a conventional analyser (not shown in FIG. 3) in a direction perpendicular to the plane of FIG. 3 to provide the two-dimensional image as indicated schematically in FIG. 2.

Each of the three lenses 24, 28 and 30 consists of a series of metal cylinders to which predetermined potentials are applied to adjust the focussing of the electron beams. Such lenses are in general use and their operating parameters such as image distances and focal lengths may be obtained from standard lens tables to provide desired performance characteristics. For example, increasing the length of the image and the solid angle of acceptance both increase the sensitivity but also degrade the spot size and therefore the energy resolution. The final design will therefore be a compromise between these various factors. Some chromatic aberration is inevitable in each of the lenses as each lens is seeking to focus electrons having a range of energies.

The lenses also incorporate deflectors 31, 32, 33 and 34 which steer the electron beams in order to correct for stray fields and misalignments. These deflectors are conventional and consist of two metal plates equispaced about the beam with voltages $Vo \pm \Delta V$ applied to give a transverse electric field with mean potential Vo. Thus the deflectors cause no rotation of the image. The resistive plates 27 do cause rotation however as will be described with reference to FIG. 4.

Figure 4:
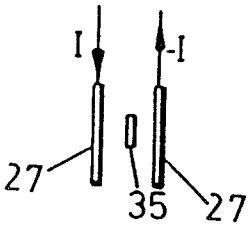
FIG. 4 is a schematic illustration of components shown in FIG. 3 for rotating an electron beam.

Referring to FIG. 4, the resistive plates 27 are equispaced around the electron beam 35, the intended orientation of the electron beam 35 relative to the plates 27 being illustrated in FIG. 4 as the electron beam enters the space between the two plates 27. Equal and opposite currents I are passed through the two plates 27 so that the potential at the mid-point between the plates is Vo but the field varies from 0 at the mid-point to $+E$ and $-E$ at the two extreme ends of the image. This has the effect of twisting the image and by adjusting the magnitude and direction of the current the magnitude and direction of the angle of twist can be adjusted to provide the desired rotation.

The data contained within the final image may be processed in any convenient manner. Preferably as described above the final image is analysed by a two dimensional array, for example a charge coupled device or a photodiode array. Some simplification of the processing of the data can be introduced however. For example if a small range of impact energies is not significant to a particular investigation then spectra produced in individual columns in the analyser array (for example the column analyzing the area 21 of FIG. 2) can be added with appropriate shifts to produce one spectrum with an increased signal rate. Alternatively, when measuring excitation functions it is possible to make use of data obtained from different columns of the analyser array to measure the intensities for a number of transitions over a range of different energies simultaneously.

Implementation of the present invention does raise certain potential problems as compared with the monochromatic beam systems of the prior art. Examples of such problems are:

A. Chromatic aberration.

B. Off-axis aberration.

C. Changes in dispersion of the image at the target.

D. Increased rate of data production.

Chromatic aberration results from the range of electron energies in the electron beams passing through the lenses. For high resolution measurements however the range of energies is very small and accordingly chromatic aberration is not a major problem.

Off-axis aberrations result from the use of an extended image. Off-axis aberration can be maintained within reasonable limits over the whole of the energy ranges to be considered by using conventional lens design techniques.

Changes in dispersion of the image at the target can be minimized by the use of constant magnification electron lenses.

The increase in the rate at which data is produced can be accommodated by suitable modifications to the data processing circuitry.

I claim:

1. An electron spectrometer comprising:

an electron source for providing a beam of electrons having a predetermined energy spectrum, an electron selector for dispersing in energy the electrons of the beam to produce an elongate selector image each portion of the length of which comprises electrons having a predetermined respective energy, means for focussing the selector image on a target to produce an elongate target image including scattered electrons having a range of energies, each portion of the length of the target image resulting from a respective portion of the length of the selector image, and an analyzer for dispersing in energy the scattered electrons of the target image, the analyzer being orientated such that the electrons are dispersed in a direction substantially perpendicular to the length of the target image, whereby the analyzer produces a rectangular image made up of substantially parallel strips each including electrons of a range of energies but each resulting from the scattering by the target of electrons of a respective energy.

2. An electron spectrometer according to claim 1, wherein the electron selector and analyzer each comprise a hemispherical deflector.

3. An electron spectrometer according to claim 1, comprising:

three electron lenses positioned in series between the selector and target image positions, a first electron lens being arranged to focus the selector image on a slit orientated to pass a beam of electrons having a range of energies, a second electron lens being arranged to focus electrons passing through the slit onto the target, and a third electron lens being arranged to focus electrons scattered from the target to form the target image.

4. An electron spectrometer according to claim 3, comprising:

a pair of resistive plates arranged on opposite sides of the electron beam between the slit and the second electron lens, and means for passing equal and opposite currents through the plate to rotate the electron beam about the axis of the electron lenses.

5. A method for producing a two-dimensional image of a target in an electron spectrometer, said method comprising:

generating a beam of electrons having a range of energies dispersed in energy to produce an elongate selector image each portion of the length of which includes electrons having a predetermined respective energy, the selector image being focussed on the target to produce an elongate target image including scattered electrons having a range of energies, each portion of the length of the target image resulting from a respective portion of the length of the selector image, and the scattered electrons of the target image being dispersed in energy, the direction of dispersion of the scattered electrons being substantially perpendicular to the length of the elongate target image, whereby a rectangular image is formed made up of substantially parallel strips each including electrons of a range of energies but each resulting from the scattering by the target of electrons of a respective energy.

* * * * *